US006981699B2

(12) United States Patent
Shobowale

(10) Patent No.: US 6,981,699 B2
(45) Date of Patent: Jan. 3, 2006

(54) MARBLE BUMPER GAME APPARATUS AND METHOD OF PLAY

(76) Inventor: Adekunle Shobowale, 5440 Thornburn St., #207, Los Angeles, CA (US) 90045

( * ) Notice: Subject to any disclaimer, the term of this patent is extended or adjusted under 35 U.S.C. 154(b) by 0 days.

(21) Appl. No.: 10/826,851

(22) Filed: Apr. 15, 2004

(65) Prior Publication Data

US 2005/0230907 A1 Oct. 20, 2005

(51) Int. Cl.
*A63F 7/00* (2006.01)

(52) U.S. Cl. ..... 273/123 R; 273/118 R

(58) Field of Classification Search ..... 273/118 R, 273/118 A, 119 R, 119 A, 121 R, 121 A, 273/123 R, 123 A, 127 R; 473/17, 31
See application file for complete search history.

(56) References Cited

U.S. PATENT DOCUMENTS

| | | | | |
|---|---|---|---|---|
| 370,224 A | * | 9/1887 | Wheeler | 273/123 R |
| 537,605 A | * | 4/1895 | Felt et al. | 273/123 R |
| 1,221,181 A | * | 4/1917 | Hooper | 273/317.2 |
| 1,339,343 A | * | 5/1920 | Hulett | 273/123 R |
| 1,588,766 A | * | 6/1926 | Massey | 273/123 R |
| 3,802,707 A | * | 4/1974 | Frost | 273/123 R |
| 4,039,191 A | | 8/1977 | Breslow | |
| 4,132,411 A | | 1/1979 | Breslow | |
| 4,146,228 A | | 3/1979 | Laciste | |
| 4,251,072 A | * | 2/1981 | Anthony | 473/18 |
| 4,549,737 A | * | 10/1985 | Seyer et al. | 273/118 R |
| 4,986,542 A | * | 1/1991 | Bonnet | 273/118 R |
| 5,415,401 A | * | 5/1995 | Nagasaka | 273/110 |
| 5,839,724 A | * | 11/1998 | Bunac, Jr. | 273/127 R |
| 6,644,662 B1 | * | 11/2003 | Cao et al. | 273/123 R |

* cited by examiner

*Primary Examiner*—Raleigh W. Chiu
(74) *Attorney, Agent, or Firm*—Trojan Law Offices

(57) ABSTRACT

The present invention is directed to a marble and bumper game apparatus and method of playing the same. A game apparatus having the features of the present invention comprises at least one rollable playing piece, namely, a colored marble, and a game board. The game board comprises a baseboard covered by a thin carpeting and enclosed on all sides by a railing. The baseboard has at least one pocket formed in therein and at least one bumper attached thereto. The basic objective of the game is to shoot a marble into a pocket by avoiding the bumper.

9 Claims, 2 Drawing Sheets

MARBLE BUMPER GAME APPARATUS AND METHOD OF PLAY

BACKGROUND OF THE INVENTION

The present invention relates to a class of surface projectile games, generally of the type relating to the children's game of marbles and to the adult game of billiards. Specifically, this invention teaches a game apparatus, and method of playing the same, for shooting marbles at a plurality of pockets on a game board having a plurality of bumpers.

Young children have been playing marbles on playgrounds for generations. One popular version of the game is called "Ringer," which, as the name implies, is played in a ring, with a grouping of target marbles placed at the center. Each player has his or her own "shooter" marble that is distinctively different in color from the target marbles in the game. The object of the game is to shoot the most target marbles out of the ring with the shooter marble, from a position outside the ring. By its nature, marbles is a game of rather mundane objectives, requiring only elementary skills, and, as such, is suitable only for children.

Billiards, on the other hand, is also an old and popular game, but one for adults. Traditionally, it is an indoor parlor game played on a rectangular table having six pockets. With billiards, the shooting player employs a cue stick to strike a cue ball at the other target balls with the general objective of knocking the target balls into any one of the pockets. By its nature, in contrast to marbles, billiards is a difficult game requiring a heightened degree of calculation and skill, and thus is not a game suitable for children.

The present invention is directed to a game apparatus that is a new and improved synthesis of marbles and billiards, so as to be suitable for both children and adults alike, by combining some elements of both games in a novel way and by adding an additional element of chance as explained below. Like the game for children, the basic playing piece of the present invention is a typical marble ball. But it is not a game to be played on the ground outdoors. Rather, in a manner akin to billiards, it is played on a rectangular game board, having a plurality of pockets, each, however, of a specific color. Unlike billiards, a cue stick is not used to strike a cue ball at other target balls. Instead, a player must shoot a marble as in the traditional children game. To shoot a marble, it is necessary to roll the forefinger around the marble, cradling it tight against the thumb knuckle with the thumb tucked under the middle finger. To shoot, the thumb kicks out, thereby shooting the marble.

A common feature of both marbles and billiards as described above is that it is necessary to shoot an object ball (e.g. a shooter marble or cue ball) at a number of target balls. For the game of marbles, the objective is to knock the target marbles out of the ring. While in billiards, the objective is to knock a target ball into any one of the various pockets. By contrast, the general objective of the game of the present invention is for the shooting player to shoot a marble directly into a specific corresponding color-coded pocket on the game board. There are no target marbles involved, thus greatly simplifying the strategy of play. However, there is an added twist. The game board has a multitude of bumpers to obstruct a player from shooting a marble directly into a pocket, thereby introducing a degree of difficulty and an element of chance into the game.

For the foregoing reasons, because there is a need for a game apparatus that can be played and enjoyed by children and adults alike, the present invention teaches a new and improved marble and bumper game.

SUMMARY

The present invention is directed to a marble and bumper game apparatus and method of playing the same. A game apparatus having the features of the present invention comprises at least one rollable playing piece, namely, a colored marble, and a game board. The game board comprises a baseboard covered by a thin carpeting and enclosed on all sides by a railing. The baseboard has at least one pocket formed in therein and at least one bumper attached thereto. The basic objective of the game is to shoot a marble into a pocket by avoiding the bumper.

It is preferred that the game board comprises a baseboard having a plurality of color-coded pockets formed therein and a plurality of bumpers attached thereto. Further, the bumpers can be removably connected to the baseboard, which has holes for receiving the bumpers. In addition, the game board could also have a means for support wherein legs are attached to the baseboard which can be folded under the baseboard for stowing when the game apparatus is not being played.

In a more advanced embodiment of the present invention, the game apparatus has an electronic means for causing the bumpers to light up upon being contacted by a marble and for generating special effects sound when a marble is pocketed.

To play the game, each player is assigned an equal number of pockets and corresponding marbles. Each player takes a turn to try and shoot a marble from the center of the baseboard into the correct colored pocket. Alternatively, the marble can be shot from the position where it comes to rest for each subsequent shot after the first shot that is taken from the center of the baseboard. The object is for each said player to shoot all of his or her marbles into the correct corresponding pocket. If a player is able to shoot a marble into its respective pocket, then the player will be permitted a second shot, and continuing so on until the player misses or pockets a marble into a wrong pocket. If the player misses by not pocketing a marble, or if the player pockets a marble into a pocket of the wrong color, then the player will lose his or her turn to the other player. And if the player shoots his or her marble into one of the opponent's pockets, then the shooting player will be penalized by having to forfeit a marble already pocketed or, alternatively, the opposing player will be rewarded an extra free shot. Thus, the player to first pocket all of his or her marbles into the correct colored pockets wins the game.

Alternatively, the game can be played using a scoring system wherein a successful shot into the correct colored pocket scores as one point. A shot into the wrong colored pocket does not score any point, while a shot into any of the opponent's pockets will count as a negative score of one point. The first player to score a certain predetermined number of points wins.

BRIEF DESCRIPTION OF THE DRAWINGS

These and other features, aspects, and advantages of the present invention will become better understood with regard to the following description, appended claims, and accompanying drawings where:

DESCRIPTION OF THE INVENTION

Figure 1:
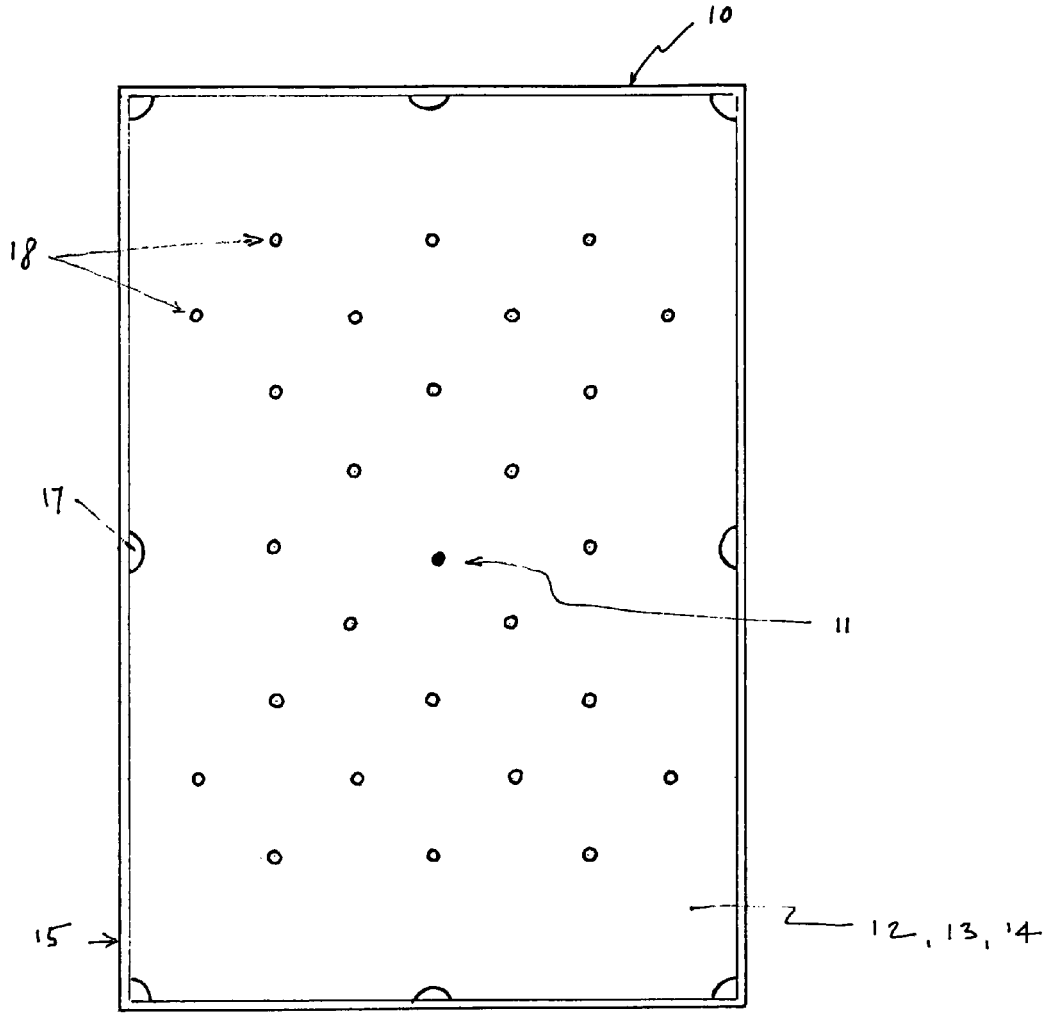
FIG. 1 is a top plan view of a version of the game apparatus.

As shown in FIG. 1, the game apparatus 10 comprises a marble ball 11 and a game board 12.

The game apparatus 10 will have at least one marble 11, or preferably a plurality of marbles, each a different contrasting color, number, or symbol. The marbles will have the shape and size of common marble balls.

The game apparatus 10 will have a game board 12 with a polygonal baseboard 13 of any standard geometric shape, but preferably that of a square or rectangle. The baseboard 13 can be the size of any standard board game. In a preferred rectangular embodiment, for example, a good proximate size for baseboard 13 is 36 inches long by 24 inches wide. The baseboard 13 can be constructed of any standard board material, such as cardboard, wood, plastic or the like. The playing surface of baseboard 13 should preferably have a thin carpeting 14 in imitation of the traditional felt carpeting found on a billiards table. The carpeting 14 provides an optimal surface for reducing the velocity of said marble 11 to a best speed for playing.

Further, the baseboard 13 is enclosed on all sides by railing 15, the function of which is to allow a player to bank the marble 11 and also to keep the marble 11 in the playing area. In a rectangular embodiment of the game apparatus 10, the baseboard 13 and railing 15 together form a rectangular tray game board 12.

Figure 2:
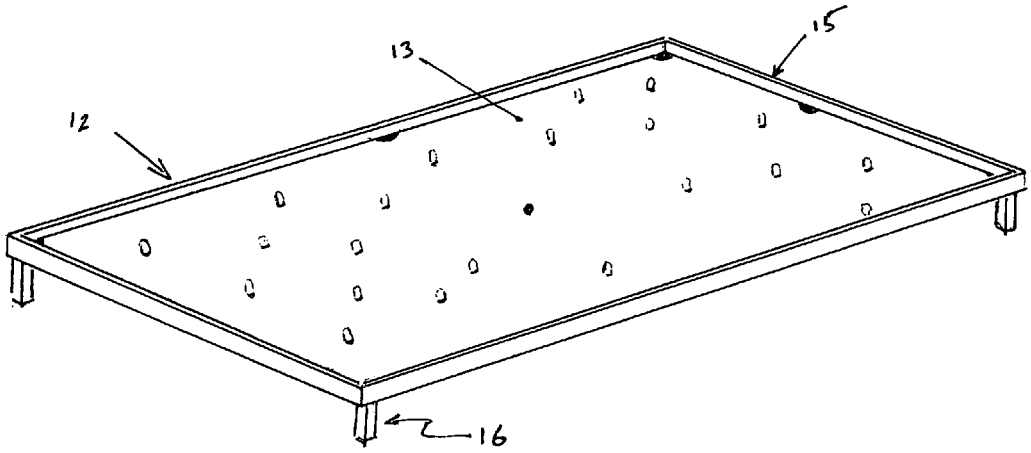
FIG. 2. is a perspective view of a version of the game apparatus.

In another preferred embodiment, as shown in FIG. 2, the game board 12 will have a means for support comprising a set of legs 16 attached to the baseboard 13 that can be folded under said baseboard 13 for stowing when the game apparatus 10 is not being played. When the legs 16 are unfolded, the game apparatus 10 is elevated so as to resemble a miniature billiards table.

The baseboard 13 will have at least one pocket 17 formed therein, though a plurality of pockets is more preferable, each pocket capable of accommodating said marble 11. The pockets will be located adjacent to the railing 15 of baseboard 13. Each pocket 17 will have a color, number, or symbol corresponding to the color, number, or symbol of each said marble 11. For example, for a blue marble, there will be a blue pocket.

The game board 12 will have at least one bumper 18 attached to the baseboard 13 thereto. The bumper 18 can be of any shape, but a cylindrical shape is best. The width of the bumper 18 should be approximate to the diameter of said marble 11 and its height should be no higher than the railing 15. In a preferred embodiment, a plurality of bumpers are staggered evenly across the playing area of the baseboard 13 so as to obstruct said marble 11 from being shot into said pockets 17. In another embodiment of the apparatus 10, the game board 12 will have a plurality of bumpers 18 removably connected to the baseboard 13 by means of a plurality of peg holes in the baseboard 13 into which said bumpers 18 can be inserted.

In an exemplary embodiment, the game apparatus 10 will have a rectangular baseboard 13 having eight pockets 17 symmetrically spaced, one at each of the four corners, and side pockets located equal distance between the respective corner pockets. Each pocket 17 will have a specific color or be coded by an number or symbol. For each colored or coded pocket 17, there will be a marble 11 of corresponding color, number, or symbol, e.g. a red marble for a red pocket, and so on. As such, in this embodiment, there will be eight colored marbles. The baseboard 13 will also be studded with a plurality of cylindrical bumpers 18 evenly spaced and staggered across the face of the baseboard 13.

In an electronic embodiment of the present invention, the game apparatus 10 will have an electronic means for causing said bumper 18 to light up upon being contacted by said marble 11. The game apparatus 10 will also have an electronic means for generating special effects sounds when said marble 11 is pocketed into said pocket 17.

There are various schemes for playing the game apparatus 10 of the present invention. The game can be played by one player or, preferably, with a multitude of players. In a preferred embodiment, the game will be played two players, each assigned an equal number of pockets 17 and corresponding marbles 11. Each player will take a turn to shoot a marble 11 into its respective colored pocket 17. The object is for a player to shoot all of his or her marbles 11 into the correct corresponding pocket 17. The first player to do this wins.

For example, in a game involving two players, played on a game board having eight pockets, then each player will have four marbles and four corresponding pockets. Player one will begin by taking a first shot from the center of the baseboard 13. There are two schemes for the shooting position of marble 11. In one, the marble 11 is always to be shot from the center of the baseboard 13 each time a player takes a turn. Alternatively, the marble 111 can be shot from the position where it comes to rest for each subsequent shot after the first shot that is taken from the center of the baseboard 13. Further, if a player is able to shoot a marble 11 into its respective pocket 17, then that player will be permitted a second shot, and continuing so on until the player misses or pockets the marble 11 into a wrong pocket 17. If a player misses by not pocketing a marble 11, or if the player pockets the marble into a pocket 17 of the wrong color, then the player will lose his or her turn to the other player. If a player shoots his or her marble 11 into one of the opponent's pockets 17, then the shooting player will be penalized by having to forfeit a marble already pocketed or, alternatively, the opposing player will be rewarded an extra free shot. In this way, the player to first pocket all of his or her marbles into the correct coded pockets wins the game. Thus, in this example, the first player to pocket all four marbles is the winner.

Alternatively, the game can be played using a scoring system. For example, a successful shot into the correct colored pocket scores as one point. A shot into the wrong colored pocket does not score any point, while a shot into any of the opponent's pockets will count as a negative score of one point. The first player to score a certain predetermined number of points wins.

In yet another embodiment for a method of playing the game, the players take turns shooting the same marble one at a time. For example, if there are two players, then player one begins by attempting to shoot a red marble into a designated red pocket. If player one misses, then player two will then be permitted to shoot the same red marble from the position where the marble came to rest after player one's shot, instead of having to re-shoot the marble from the center. The game is continued in this way with each player taking a turn shooting the marble until it is successfully pocketed into the correct pocket. When all the marbles are pocketed, the player who pocketed the most number of marbles is the winner.

What is claimed is:

1. A game apparatus comprising:

(a) a game board having a baseboard and enclosed on all sides by a railing, (b) at least one rollable playing piece for shooting by a player on said game board into a pocket;

(c) said baseboard covered by a thin carpeting;

(d) said baseboard having a plurality of pockets formed therein, each coded by color, number or symbol; and (e) said baseboard having a plurality of bumpers attached thereto.

2. The game board of claim 1, wherein said baseboard has a hole or plurality of holes for which said bumper or bumpers can be removably connected thereto.

3. The game board of claim 1 further comprising a means for support wherein legs are attached to said baseboard which can be folded under said baseboard for stowing when said game apparatus is not being played.

4. The game apparatus of claim 1, wherein said rollable playing piece is a marble.

5. The game apparatus of claim 1 having a plurality of rollable playing pieces, each of a contrasting color, number, or symbol corresponding to the color, number, or symbol of each said pocket.

6. The game apparatus of claim 1 having electronic means for:

(a) causing said bumper to light up upon being contacted by said rollable playing piece; and (b) generating special effects sound when said rollable playing piece is pocketed.

7. A method of playing a game on a game apparatus using a game board having a baseboard and enclosed on all sides by a railing, said baseboard having at least one pocket formed therein and at least one bumper attached thereto, and at least one rollable playing piece for shooting by a player on said game board into said pocket, said method comprising:

(a) designating each player an equal number of said pockets and corresponding said rollable playing pieces;

(b) designating a turn for each said player to shoot said rollable playing piece into its respective coded pocket;

(c) designating an objective for each said player to shoot all of his or her rollable playing pieces into the correct corresponding pocket;

(d) shooting said rollable playing piece from the center of said baseboard for each shot or, alternatively, shooting said rollable playing piece from the position where it comes to rest for each subsequent shot after the first shot that is taken from the center of said baseboard;

(e) awarding said player a second shot if said player successfully shoots said rollable playing piece into its respective pocket, and continuing so on until said player misses or pockets said rollable playing piece into a wrong pocket;

(f) penalizing said player a turn by awarding a turn to another player if said player misses by not pocketing said rollable playing piece, or if said player pockets said rollable playing piece into a pocket of the wrong color, number or symbol;

(g) penalizing said player by having said player forfeit a rollable playing piece already pocketed or, alternatively, rewarding the opposing player with an extra free shot if said first player shoots his or her rollable playing piece into one of said opposing player's pockets; and (h) determining the winner according to the player to first pocket all of his or her rollable playing pieces into the correct coded pockets.

8. A method of scoring the game in claim 7, said method of scoring comprising:

(a) a successful shot into the correct colored pocket scores as one point;

(b) a shot into the wrong colored pocket does not score any point; and (c) a shot into any of the opponent's pockets will count as a negative score of one point; and (d) the first player to score a certain predetermined number of points wins.

9. A method of playing a game on a game apparatus using a game board having a baseboard and enclosed on all sides by a railing, said baseboard having at least one pocket formed therein and at least one bumper attached thereto, and at least one rollable playing piece for shooting by a player on said game board into said pocket, said method comprising:

(a) taking turns to shoot the same rollable playing piece by one player at a time;

(b) shooting said rollable playing piece by first player into a designated coded pocket;

(c) shooting said rollable playing piece by second player into said designated pocket if said first player misses, said shooting taken from the position where said rollable playing piece came to rest after said first player's shot; and (d) determining the winner when all said rollable playing pieces are pocketed according to the player who pocketed the most number of rollable playing pieces.

* * * * *